United States Patent [19]

Rousseau, Jr. et al.

[11] 4,131,079

[45] Dec. 26, 1978

[54] WIND ROTATED REFLECTIVE SCARECROW

[76] Inventors: John F. Rousseau, Jr., 34 Fernway Rd.; Charles E. Babin, 120 Jerusalem Rd., both of Cohasset, Mass. 02025

[21] Appl. No.: 839,751

[22] Filed: Oct. 5, 1977

[51] Int. Cl.[2] ..... G09F 11/02

[52] U.S. Cl. ..... 116/22 A; 40/479; 116/117 R; 248/121; 350/99

[58] Field of Search ..... 116/22 A, 274; 40/39, 40/138, 479; 350/97, 99; 46/138; 52/101

[56] References Cited

U.S. PATENT DOCUMENTS

| | | | |
|---|---|---|---|
| D. 198,154 | 5/1964 | Hill | 40/138 X |
| 278,461 | 5/1883 | Screven | 43/2 X |
| 954,288 | 4/1910 | Holloway | 40/138 |
| 1,066,045 | 7/1913 | Pass | 116/22 A |
| 1,287,968 | 12/1918 | Greenleaf | 116/22 A |
| 2,117,501 | 5/1938 | Raymond | 40/138 X |
| 2,722,195 | 11/1955 | Rockafeller | 116/22 A |
| 3,085,545 | 4/1963 | Ore | 116/22 A |
| 3,290,817 | 12/1966 | Kravath | 40/39 X |
| 3,868,294 | 2/1975 | Gayle | 350/97 X |
| 4,038,639 | 8/1977 | Kuebler | 52/101 |

*Primary Examiner*—Daniel M. Yasich

*Attorney, Agent, or Firm*—Cesari and McKenna

[57] ABSTRACT

An effective but inexpensive device for scaring pests, such as birds, from an area to be protected is formed from an elongated, vertically extending post; a resilient wire mounted on, and extending from, the upper end of the post; and a pair of large, thin, light weight, highly light reflective discs rotatably suspended from the remote end of the wire in cantilever fashion and responsive to wind forces on the discs in order to provide a random, distracting motion as well as to cast darting light reflections in a random, erratic manner on the area surrounding the post.

10 Claims, 1 Drawing Figure

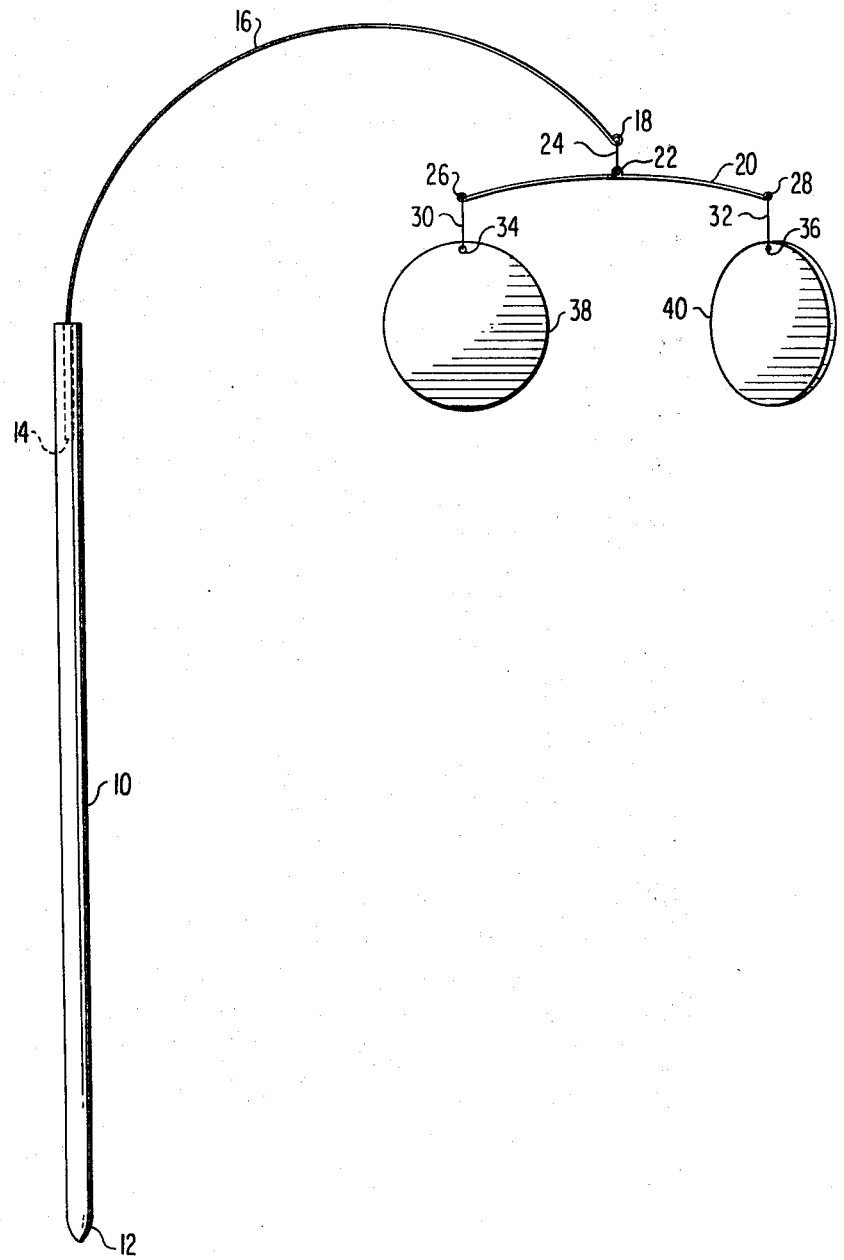
16
18
24
22
20
26
28
30
34
32
36
38
40
14
10
12

WIND ROTATED REFLECTIVE SCARECROW

BACKGROUND OF THE INVENTION

A. Field of the Invention

The invention relates to pest-scaring devices, hereinafter referred to as "scarecrows", and, more particularly, comprises an effective but inexpensive scarecrow of simple construction.

B. Prior Art

The term "scarecrows" is commonly applied to inanimate figures placed in a field or other area for the purpose of scaring pests, particularly, birds, away from the area. The figures are most commonly found in the form of a replica of a human. The replica may be in the form of a wholly immobile, rigid structure such as indicated in U.S. Pat. No. 1,111,195 (Thayer), or may be mounted for one or more wind-responsive motions, as in U.S. Pat. No. 1,286,380 (Matthews). Animal figures are sometimes used in place of human figures, as illustrated, for example, by U.S. Pat. Nos. 2,545,801 (Wrazen) and 3,735,514 (Asdere). These devices are of limited effectiveness, and it is not unusual to see the very birds to be chased away perched on the top of the scarecrow, particularly, if it is capable of only limited movement. Further, the construction of many of these is unduly expensive, particularly in relation to their limited effectiveness.

Scarecrows providing somewhat greater movement capabilities and generally simpler structure are shown in U.S. Pat. Nos. 1,167,502 (Huffman et al); 3,085,545 (Ore); and 3,487,569 (Mendell). The scarecrows illustrated in these patents are formed by suspending an animal figure from a fixed support by means of a flexible line which provides responsiveness to wind. Again, however, the structures are such as to limit the motion of the figures and their effectiveness in scaring off pests is correspondingly limited.

Brief Description of the Invention

A. Objects of the Invention

Accordingly, it is an object of the invention to provide an improved scarecrow.

Further, it is an object of the invenion to provide an effective, but inexpensive scarecrow.

Yet a further object of the invention is to provide a scarecrow of simple structure that is highly effective for its purpose.

Still a further object of the invention is to provide a scarecrow of simple construction that is relatively impervious to the elements.

Another object of the invention is to provide an effective scarecrow that is readily disassembled and reassembled.

B. Brief Summary of the Invention

The present invention is predicated on the conviction that the most effective scarecrow device is one that provides erratic and randomly occuring motion that penetrates the territory in the vicinity of the pest to be chased and thereby threatens its "territoriality". In particular, we have found that an effective scarecrow can be formed by mounting a plurality of large, thin, light weight, highly light-reflective discs for rotational and translational motion about a plurality of axes, in response to wind forces on the discs, to thereby direct beams of light in a relatively random and erratic manner onto the area surrounding the discs and varying distances from them. During motion of these discs in response to wind forces, a relatively large area is subjected to the reflected light rays and thus substantial coverage is provided by the scarecrow, even at large distances from it.

More specifically, the scarecrow device of the present invention takes the form of an elongated post, one end of which is planted firmly in the ground, the other end of which extends vertically above the ground and carries an elongated, resilient wire extending axially from the upper end of the post and mounted for rotation about the axis of the post. For this purpose, the wire is preferably simply placed into an axially extending central slot in the upper end of the post and of a diameter slightly larger than the thickness of the wire so as to allow free rotation of the wire therein.

Mounted on the end of the wire remote from the post is a horizontally extending arm or yoke from the ends of which reflective discs are extended. The discs are preferably connected to the yoke through threads of little torsional resistance to allow relatively free rotation of the discs with respect to the yoke. Likewise, the yoke is preferably connected to the wire by means of a similar thread of limited torsional restraint so that the yoke itself may also rotate about both vertical and horizontal axes in response to forces applied to it. This mounting allows the discs to rotate about three distinct vertical axes simultaneously in response to wind forces, namely, their own vertical axes, a vertical axis coincident with the yoke support, and the longitudinal (vertical) axis of the post.

Further, the discs are preferably of very light and equal weight and suspended at equal distances from the center of the horizontal yoke so that they are effectively closely counterbalanced; thus, any unequal forces on the discs in a vertical direction will disturb the balance and cause the discs to move upwardly and downwardly (oscillate) about an effective horizontal axis passing through the yoke support. Additionally, the cantilever wire itself undergoes vertical oscillations in response to net vertical forces on the disc. These rotational and translational motions all combine to provide the desired highly erratic, random motion.

The components of the scarecrow device are simple and inexpensive. Furthermore, the interconnections are quickly and inexpensively made. The result is an efficient, yet inexpensive scarecrow structure. Further, because of its simplicity, it is relatively immune to the elements. Additionally, the wire suspension elements may simply and quickly be removed from the post and stored, with or without the posts, during seasons when the protection of the scarecrow is not desired. Thus, it provides an essentially trouble free, quickly-erected and quickly-disassembled area protective device.

DETAILED DESCRIPTION OF THE INVENTION

The foregoing and other and further objects and features of the invention will be more readily understood on reference to the following detailed description of the invention, when taken in conjunction with the accompanying single FIGURE of the drawing.

Referring now to the drawing, an elongated post 10 having a pointed tip 12 at a lower end thereof for driving into the ground carries a longitudinally extending bore 14 at the upper end thereof. Loosely and rotatably mounted in the bore 14 is a wire 16 terminating at the remote end thereof in an eyelet 18 from which a yoke 20 is cantilevered. Preferably, the yoke 20 has a loop 22 at the midpoint thereof; a thread 24, running between this loop and the eyelet 18, connects the yoke to the wire 16.

Eyelets 26 and 28 formed at the opposite ends of the yoke 20 carry downwardly extending threads 30, 32 which connect to through holes 34, 36 and discs 38, 40, respectively. The threads 24, 30 and 32 provide low torsional resistance to rotation. Thus, the discs 38, 40 readily turn about their vertical axes which are coincident with threads 30, 32, as well as about the vertical axis coincident with thread 34 in response to forces on the discs. Additionally, when sufficient horizontal wind force is applied to the discs, they apply a force through yoke 20 to wire 16 and cause the wire to rotate about the axis of the post 10 and, accordingly, the discs also rotate about this axes as well. Further, because the discs are light weight and are symmetrically located about the midpoint of the yoke 20, they are counterbalanced about this point and any slight vertical unbalance will cause them to move in opposite directions about a horizontal axis perpendicular to yoke 20 and extending through loop 22. Added to this is the vertical translatory motion of the tip of the wire 16 (at eyelet 18).

The result of all these motions is a complex, erratic, random motion of the discs in space. When light such as sunlight is incident on the discs, the reflected light beam traces, on the ground, an apparently magnified, erratic, random path which may extend substantially outwardly (radially) about the post 10 and thus cover a large area surrounding the post. It is this erratic, darting motion of the discs, together with the resulting motion of the light beam, which is believed to constitute the major effective deterent to the pests in the area of the scarecrow described here.

The components of the device illustrated in the drawing are inexpensive to manufacture. As an example of the preferred construction, the post 10 advantageously comprises a three quarter inch round hardwood staff (dowel) thirty six inches in length, with a recess 14 two and a half inches in length and slightly larger in diameter than the diameter of the wire 16. The wire 16 comprises a thirty inch length of 60 mil (.060 inch) stainless steel wire; this provides substantial springiness for the discs 38 and 40, to thereby accentuate the motional response to forces applied thereto. The yoke 20 is similarly formed from 60 mil stainless steel wire, thirteen inches in length, while the threads 24, 30, and 32 are formed from nylon line, each two and a half inches in length. Finally, the discs 39 and 40 are advantageously circular discs, five and a half inches in diameter and 30 mils thick, of styrene plastic material that has been vacuum-plated with a chrome mirror finish for maximum light reflection, and preferably coated with a protective clear lacquer. The light weight of the discs and their counterbalance suspension makes them highly motionally responsive to even slight wind forces.

SUMMARY

From the foregoing, it will be seen that we have provided an improved scarecrow. Although formed of simple parts, and thereby inexpensive to make and assemble, the device is highly effective in providing a variety of multiple rotational movements in response to even slight wind forces to thereby simultaneously direct reflected light beams with highly complex, erratic random motion over a wide area surrounding the device. Because of its simplicity and durability, it may readily be transported from place to place as desired or may be quickly disassembled for storage and subsequently reassembled for use.

It will be understood that various changes may be made in the proportioning and other details of the invention without departing from either the spirit or the scope thereof, it being understood that the foregoing is to be taken as illustrative only and not in a limiting sense, the scope of the invention being defined with particularity in the claims.

Having illustrated and described our invention, we claim:

1. A scarecrow, comprising

A. an elongated post for vertical mounting in a field;

B. an elongated resilient wire having one end thereof extending axially from, and rotatably mounted on, one end of said post;

C. at least one highly reflective disc rotatably suspended from the other end of said wire;

D. the wire portion intermediate said ends forming an arc opening downwardly in response to its own weight and the weight of said disc to provide an oscillatory motion in response to slight forces on said other end, E. said wire and said disc both rotatably responsive to wind forces on said disc to thereby direct light reflected from said disc about a substantial area surrounding said post.

2. A scarecrow according to claim 1

(1) in which said disc is suspended from said wire by means of a yoke connected to said wire; and (2) which includes a plurality of highly force-responsive and light-reflective discs suspended from said yoke.

3. A scarecrow according to claim 2 in which said discs are each rotatably suspended from said yoke.

4. A scarecrow according to claim 3 in which said discs are suspended from said yoke by means of threads connecting the respective discs to the yoke and providing low torsional restraint to rotation.

5. A scarecrow according to claim 2 in which said yoke is suspended from said wire by a thread providing low torsional restraint to rotation.

6. A scarecrow according to claim 1 in which said disc comprises a generally circular thin disc coated with a material of high reflectivity on opposed faces thereof.

7. A scarecrow comprising

A. an elongated post for placement in the ground in an area to be protected,

B. an elongated resilient wire having a first end rotatably mounted in, and extending axially from, an upper end of said post and having a second end thereof extensible radially of said post and forming a downwardly opening arc highly responsive to vertical forces applied to said second end, C. a yoke rotatably mounted on said second end of said wire, D. a plurality of highly reflective discs rotatably suspended from said yoke and supported by said wire in cantilever fashion radially outwardly of said post, said discs being responsive to wind forces thereon to rotate about a plurality of generally vertical axes and oscillate about a plurality of horizontal axes to thereby cast light beams erratically in varying directions and at various distances from said post.

8. A scarecrow according to claim 7 in which said discs are connected to said yoke by means of threads of low torsional resistance to facilitate rotation in response to wind forces.

9. A scarecrow according to claim 8 in which said yoke is connected to said wire by means of a thread of low torsional resistance to facilitate rotation in response to wind forces.

10. A scarecrow according to claim 9 in which said discs comprise generally circular thin plates of plastic material, each in excess of four inches in diameter, and each coated on opposed faces thereof with a highly reflective metallic coating.

* * * * *